US010135209B1

(12) United States Patent
Wynnik et al.

(10) Patent No.: US 10,135,209 B1
(45) Date of Patent: Nov. 20, 2018

(54) BUSWAY STAB ASSEMBLIES AND RELATED SYSTEMS AND METHODS

(71) Applicant: Eaton Corporation, Cleveland, OH (US)

(72) Inventors: Michael Anthony Wynnik, Pelzer, SC (US); Gordon Stanley Pettersen, Greenwood, SC (US); John Michael Kokenda, Greenwood, SC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/587,698

(22) Filed: May 5, 2017

(51) Int. Cl.
*H01R 13/631* (2006.01)
*H01R 25/16* (2006.01)
*H01R 43/20* (2006.01)

(52) U.S. Cl.
CPC ..... *H01R 25/162* (2013.01); *H01R 13/631* (2013.01); *H01R 43/20* (2013.01)

(58) Field of Classification Search
CPC .... H01R 25/14; H01R 25/142; H01R 25/145; H01R 25/162
USPC ..... 439/115, 117, 118, 122, 213
See application file for complete search history.

(56) References Cited

U.S. PATENT DOCUMENTS 3,531,758 A * 9/1970 Blumkin ..... H01R 25/14 174/88 B
3,559,146 A 1/1971 Valtonen
3,718,816 A 2/1973 Seelbach et al.
3,737,834 A 6/1973 Contratto
3,801,951 A 4/1974 Kemmerer et al.
3,813,633 A * 5/1974 Clement ..... H01R 25/142 439/118
3,832,503 A * 8/1974 Crane ..... H01R 25/142 200/51 R
3,848,715 A 11/1974 Hesse
(Continued)

FOREIGN PATENT DOCUMENTS

DE 2119572 11/1972
DE 2123152 11/1972
(Continued)

OTHER PUBLICATIONS

Starline Track Busway, Busway Series B60, B100C, B160, B225, Products, Components and Accessories, Universal Electric Corporation, www.uecorp.com, Cat. No. 1-01, available as of filing date.

*Primary Examiner* — Edwin A. Leon
*Assistant Examiner* — Oscar Jimenez
(74) *Attorney, Agent, or Firm* — Myers Bigel, P.A.

(57) ABSTRACT

A plug-in device for use with a busway system comprising a busway housing defining a longitudinal axis includes a stab base housing having first and second opposite sides, one or more stab conductors extending out of and away from the stab base housing at each of the first and second sides of the stab base housing, and a first alignment tab on the first side of the housing and a second alignment tab on the second side of the housing. The stab base housing is configured to be received through an opening at a bottom portion of the busway housing and positioned in a first position and then rotated from the first position to a second position. The first and second alignment tabs are configured to allow rotation from the first position to the second position in only one rotational direction.

18 Claims, 15 Drawing Sheets

(56) References Cited

U.S. PATENT DOCUMENTS

| | | | | |
|---|---|---|---|---|
| 3,933,403 | A | 1/1976 | Rubesamen et al. | |
| 3,973,818 | A | 8/1976 | Soquenne | |
| 4,032,208 | A | 6/1977 | Berkenhoff | |
| 4,163,595 | A | 8/1979 | Vasseur | |
| 4,655,520 | A | 4/1987 | Cummings | |
| 4,676,567 | A * | 6/1987 | Mouchi | H01R 25/14 439/116 |
| 4,822,292 | A | 4/1989 | Thayer et al. | |
| 4,919,625 | A * | 4/1990 | Coutre | H01R 25/14 439/118 |
| 4,950,841 | A | 8/1990 | Walker et al. | |
| 5,811,733 | A | 9/1998 | Flaig | |
| 5,821,464 | A | 10/1998 | Graham et al. | |
| 6,033,239 | A | 3/2000 | Jaakkola et al. | |
| 6,039,584 | A | 3/2000 | Ross | |
| 6,105,741 | A | 8/2000 | Ross | |
| 6,176,711 | B1 | 1/2001 | Rohr et al. | |
| 6,203,339 | B1 | 3/2001 | Nieminen | |
| 6,296,498 | B1 | 10/2001 | Ross | |
| 6,358,070 | B1 | 3/2002 | Lin | |
| 6,517,363 | B2 | 2/2003 | Ross | |
| 6,521,837 | B2 | 2/2003 | Hilgert et al. | |
| 6,884,095 | B1 | 4/2005 | Tsai | |
| 7,455,535 | B2 * | 11/2008 | Insalaco | H01R 25/14 439/110 |
| 7,614,895 | B2 | 11/2009 | Jur et al. | |
| 7,718,895 | B2 | 5/2010 | Rodriguez | |
| 7,744,386 | B1 | 6/2010 | Speidel et al. | |
| 7,819,676 | B1 | 10/2010 | Cardoso et al. | |
| 8,469,727 | B2 | 6/2013 | Lindenau et al. | |
| 8,506,310 | B2 * | 8/2013 | Brandberg | H01R 25/142 439/117 |
| 8,550,830 | B1 | 10/2013 | Bhathija et al. | |
| 8,664,530 | B2 * | 3/2014 | Ross | H01R 25/14 174/133 B |
| 8,697,993 | B2 | 4/2014 | Jur et al. | |
| 8,899,999 | B2 | 12/2014 | MacKiewicz | |
| 9,190,791 | B1 | 11/2015 | Jaena et al. | |
| 9,197,045 | B2 | 11/2015 | Jur et al. | |
| 9,275,774 | B2 * | 3/2016 | Ross | H01R 25/14 |
| 9,379,502 | B2 | 6/2016 | Davidson, Jr. et al. | |
| 9,520,688 | B2 | 12/2016 | Sheridan et al. | |
| 9,608,392 | B1 * | 3/2017 | Destro | H01R 9/26 |
| 9,673,583 | B2 * | 6/2017 | Hudson | H01R 4/64 |
| 9,690,162 | B2 * | 6/2017 | Wilbur | H01R 41/00 |
| 2007/0212932 | A1 | 9/2007 | Jur et al. | |
| 2008/0090432 | A1 * | 4/2008 | Patterson | H01R 25/142 439/121 |
| 2015/0236462 | A1 * | 8/2015 | Davidson, Jr. | H01R 25/142 439/122 |
| 2016/0049759 | A1 | 2/2016 | Jaena et al. | |
| 2016/0104985 | A1 * | 4/2016 | Ewing | A47F 3/001 211/26 |
| 2016/0344148 | A1 * | 11/2016 | Mullins | E06B 9/24 |
| 2016/0372909 | A1 * | 12/2016 | Baldwin | H02G 5/06 |
| 2017/0170616 | A1 * | 6/2017 | Wynnik | H01R 25/162 |

FOREIGN PATENT DOCUMENTS

| | | |
|---|---|---|
| DE | 2131065 | 1/1973 |
| DE | 3025913 | 2/1982 |
| EP | 1956688 | 8/2008 |

* cited by examiner

BUSWAY STAB ASSEMBLIES AND RELATED SYSTEMS AND METHODS

BACKGROUND

Busway systems typically include several elongated busway sections with busway joints between adjacent busway sections. The busway joint serves to electrically and mechanically connect the adjacent busway sections. Continuous plug-in busway systems allow for plug-in devices (e.g., outlet boxes) to be installed anywhere or substantially anywhere along the length of the busway sections.

SUMMARY

Some embodiments of the invention are directed to a plug-in device for use with a busway system including a busway housing defining a longitudinal axis. The device includes a stab base housing having first and second opposite sides, one or more stab conductors extending out of and away from the stab base housing at the first side of the stab base housing, and one or more stab conductors extending out of and away from the stab base housing at the second side of the stab base housing. The stab base housing is configured to be received through an opening at a bottom portion of the busway housing and positioned in a first position with each stab conductor extending away from the stab base housing in a direction substantially parallel to the longitudinal axis of the busway housing. The stab base housing is configured to be rotated from the first position to a second position with each stab conductor extending away from the stab base housing in a direction substantially perpendicular to the longitudinal axis of the busway housing. The stab base housing includes an alignment feature configured to allow rotation of the stab base housing from the first position to the second position in only one rotational direction.

In some embodiments, the alignment feature includes a first alignment tab on the first side of the stab base housing and a second alignment tab on the second side of the stab base housing. The first alignment tab may have a first length and the second alignment tab may have a second length that is greater than the first length.

The stab base housing may include an upper portion and a lower portion. A ground conductor may extend upwardly from the upper portion of the stab base housing. The ground conductor may be configured to resiliently contact an upper wall of the busway housing in the first position and/or in the second position.

The one or more stab conductors extending out of and away from the stab base housing at the first side of the stab base housing may include first and second phase conductors. The one or more stab conductors extending out of and away from the stab base housing at the second side of the stab base housing may include a third phase conductor. The one or more stab conductors extending out of and away from the stab base housing at the first side of the stab base housing may include a ground conductor for a 200% ground rating.

The one or more stab conductors extending out of and away from the stab base housing at the first side of the stab base housing may include first and second phase conductors. The one or more stab conductors extending out of and away from the stab base housing at the second side of the stab base housing may include a third phase conductor and a neutral conductor. The neutral conductor may be a first neutral conductor. The one or more stab conductors extending out of and away from the stab base housing at the second side of the stab base housing may include a second neutral conductor for a 200% neutral rating.

The stab base housing may include an upper portion and a lower portion. The stab base housing may include a coupling feature at the lower portion thereof for coupling the stab base housing to an enclosure. The plug-in device may include the enclosure. A cable may extend from each stab conductor to outside the stab base housing at the lower portion thereof. Each cable may be electrically connected to the enclosure at an interior thereof.

Some other embodiments of the invention are directed to a busway system. The system includes a busway section. The busway section includes a busway housing defining a longitudinal axis, with the busway housing comprising first and second opposite side portions. The busway section includes a first insulator held in the first side portion of the busway housing, with the first insulator holding one or more bus bar conductors. The busway section includes a second insulator held in the second side portion of the busway housing, with the second insulator holding one or more bus bar conductors. The system includes a plug-in device. The plug-in device includes a stab base housing having first and second opposite sides, one or more stab conductors extending out of and away from the stab base housing at the first side of the stab base housing, and one or more stab conductors extending out of and away from the stab base housing at the second side of the stab base housing. The stab base housing is configured to be received through an opening at a bottom portion of the busway housing and positioned in a first position with each stab conductor extending away from the stab base housing in a direction substantially parallel to the longitudinal axis of the busway housing. The stab base housing is configured to be rotated from the first position to a second position with each stab conductor extending away from the stab base housing in a direction substantially perpendicular to the longitudinal axis of the busway housing. Each stab base conductor is electrically connected to one of the bus bar conductors in the second position. The stab base housing includes an alignment feature configured to allow rotation of the stab base housing from the first position to the second position in only one rotational direction.

In some embodiments, the alignment feature includes a first alignment tab on the first side of the stab base housing and a second alignment tab on the second side of the stab base housing. The first alignment tab may have a first length and the second alignment tab may have a second length that is greater than the first length. The busway housing may include a first channel and a second channel at the bottom portion of the busway housing. The first channel may have a first depth and the second channel tab may have a second depth that may be greater than the first depth. The first alignment tab may be received in the first channel and the second alignment tab may be received in the second channel when the stab base housing is in the second position. The stab base housing may include a first concave rounded portion above the first alignment tab and a second concave rounded portion above the second alignment tab.

The stab base housing includes an upper portion and a lower portion. A ground conductor may include a convex upper surface that extends upwardly from the upper portion of the stab base housing. The ground conductor may be configured to resiliently contact an upper wall of the busway housing in the first position and/or in the second position.

Each bus bar conductor held in the first insulator may include an upper portion and an opposite lower portion. Each bus bar conductor held in the second insulator may include an upper portion and an opposite lower portion. In the second position, each one of the stab conductors extending out of and away from the stab base housing at the first side of the stab base housing may be received between and contact the upper and lower portions of one of the bus bar conductors held in the first insulator to be electrically connected therewith. In the second position, each one of the stab conductors extending out of and away from the stab base housing at the second side of the stab base housing may be received between and contact the upper and lower portions of one of the bus bar conductors held in the second insulator to be electrically connected therewith.

In some embodiments, each of the stab conductors includes an end portion that is tapered such that the end portion narrows in thickness from a central portion to an end of the stab conductor.

Some other embodiments of the invention are directed to a method. The method includes providing a busway section. The busway section includes: a busway housing defining a longitudinal axis, with the busway housing including first and second opposite side portions; a first insulator held in the first side portion of the busway housing, with the first insulator holding one or more bus bar conductors; and a second insulator held in the second side portion of the housing, with the second insulator holding one or more bus bar conductors. The method includes providing a plug-in device. The plug-in device includes: a stab base housing having first and second opposite sides; one or more stab conductors extending out of and away from the stab base housing at the first side of the stab base housing; and one or more stab conductors extending out of and away from the stab base housing at the second side of the stab base housing. The method includes receiving the stab base housing through an opening at a bottom portion of the busway housing in a first position with each stab conductor extending away from the stab base housing in a direction substantially parallel to the longitudinal axis of the busway housing. The method includes rotating the stab base housing from the first position to a second position with each stab conductor extending away from the stab base housing in a direction substantially perpendicular to the longitudinal axis of the busway housing. The stab base housing includes an alignment feature configured to allow rotation of the stab base housing from the first position to the second position in only one rotational direction.

In some embodiments, rotating the stab base housing from the first position to the second position includes electrically connecting each one of the stab conductors to one of the bus bar conductors.

Each bus bar conductor held in the first insulator may include an upper portion and an opposite lower portion. Each bus bar conductor held in the second insulator may include an upper portion and an opposite lower portion. Rotating the stab base housing from the first position to the second position may include receiving each one of the stab conductors extending out of and away from the stab base housing at the first side of the stab base housing between the upper and lower portions of one of the bus bar conductors held in the first insulator to be electrically connected therewith. Rotating the stab base housing from the first position to the second position may include receiving each one of the stab conductors extending out of and away from the stab base housing at the second side of the stab base housing between the upper and lower portions of one of the bus bar conductors held in the second insulator to be electrically connected therewith.

The alignment feature may include a first alignment tab on the first side of the stab base housing and a second alignment tab on the second side of the stab base housing. The first alignment tab may have a first length and the second alignment tab may have a second length that is greater than the first length. The busway housing may include a first channel and a second channel at the bottom portion of the busway housing. The first channel may have a first depth and the second channel may have a second depth that is greater than the first depth. Rotating the stab base housing from the first position to the second position may include slidably receiving the first alignment tab in the first channel of the busway housing and slidably receiving the second alignment tab in the second channel of the busway housing.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
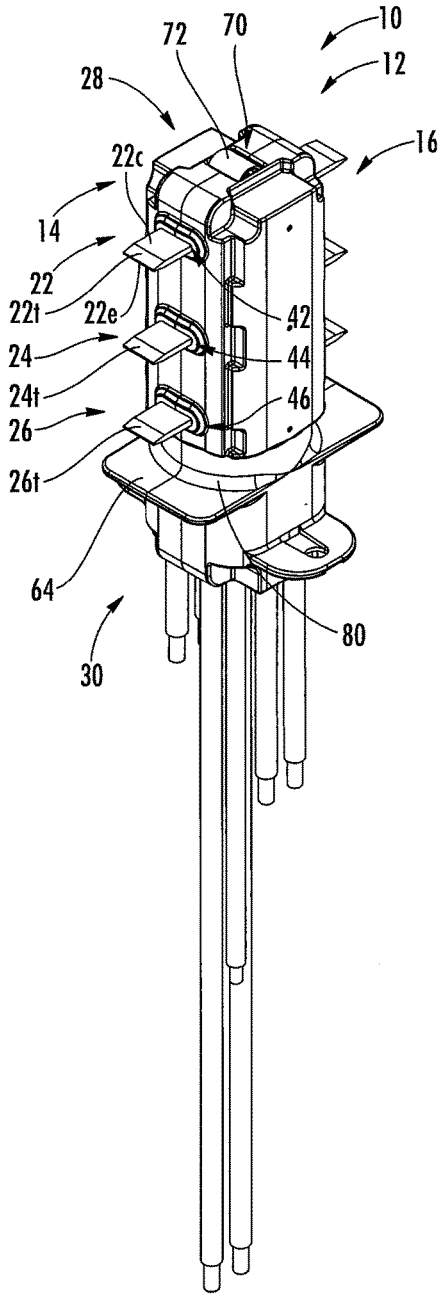
FIG. 1 is a perspective view of a stab base assembly according to some embodiments.
Figure 2:
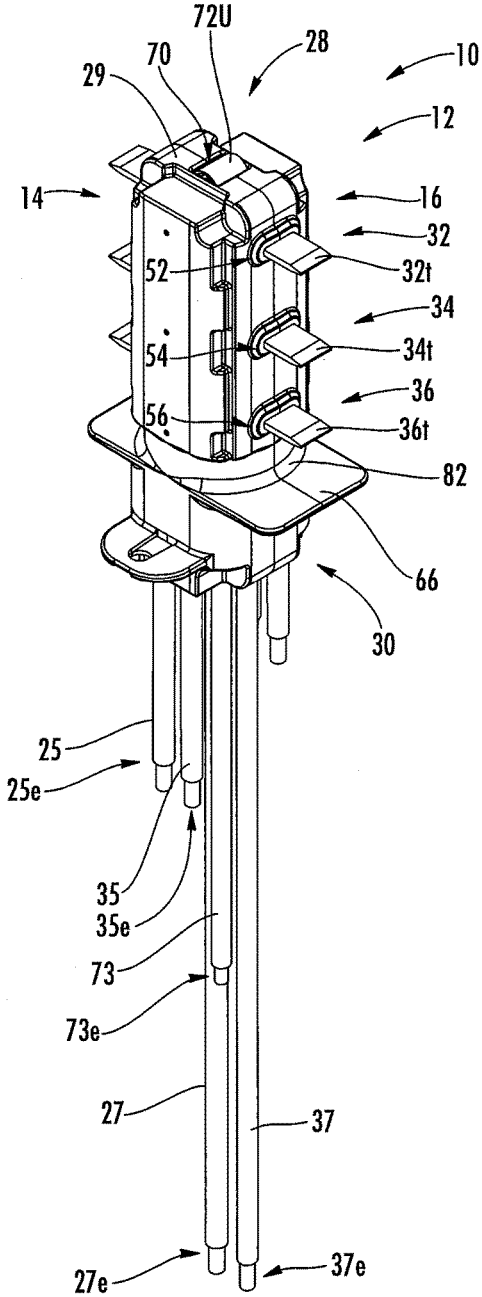
FIG. 2 is another perspective view of the stab base assembly of FIG. 1.
Figure 3:
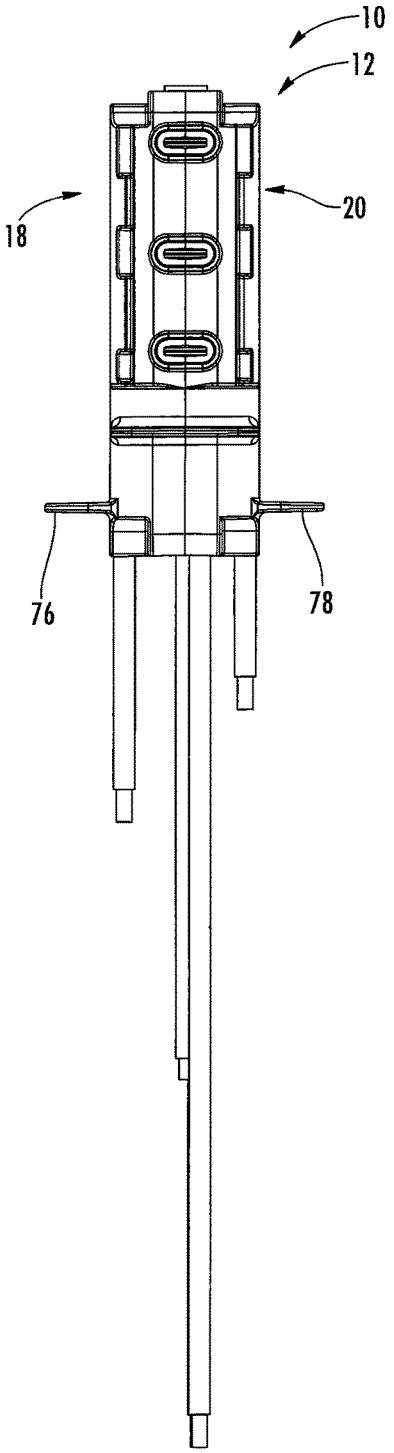
FIG. 3 is a front view of the stab base assembly of FIG. 1.
Figure 4:
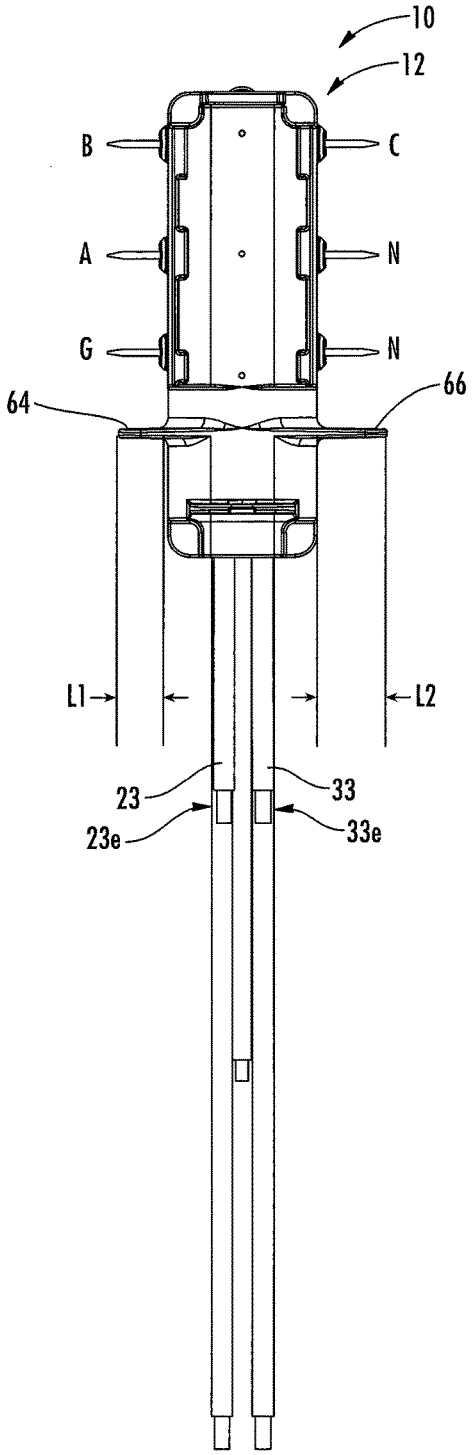
FIG. 4 is a side view of the stab base assembly of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "includes," "comprising," and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In some embodiments, the term "substantially" when used in connection with a claimed angular relationship includes angles that are ±5° of the claimed angular relationship. In some other embodiments, the term "substantially" when used in connection with a claimed angular relationship includes angles that are ±3° of the claimed angular relationship. For example, an object that extends in a direction that is substantially perpendicular to an axis may form an angle with the axis that is between 85 and 95° or between 87 and 93° in various embodiments.

A stab base assembly 10 according to some embodiments is illustrated in FIGS. 1-4. The assembly 10 includes a stab base housing 12. The housing 12 includes first and second opposite sides 14, 16 and third and fourth opposite sides 18, 20. The first and second sides 14, 16 may be parallel or substantially parallel to one another. The third and fourth sides 18, 20 may be parallel or substantially parallel to one another. The third and fourth sides 18, 20 may also be perpendicular or substantially perpendicular to each of the first and second sides 14, 16.

The stab base housing 12 may be formed of an electrically insulating material. According to some embodiments, the housing 12 is formed of a polycarbonate or a thermoplastic polycarbonate. The housing 12 may be formed of Lexan™ available from SABIC (e.g., Lexan 3412ECR).

A plurality of stabs (or stab conductors) are held by the housing 12 and extend away from the housing 12. More specifically, stabs 22, 24, 26 may extend away from the first side 14 of the housing 12 and stabs 32, 34, 36 may extend away from the second side 16 of the housing 12. The stabs 22, 24, and 26 may extend out of openings 42, 44, and 46, respectively, at the first side 14 of the housing 12. Similarly, the stabs 32, 34, and 36 may extend out of openings 52, 54, and 56, respectively, at the second side 16 of the housing 12.

The stabs 22, 24, 26, 32, 34, 36 may be formed of an electrically conductive material. According to some embodiments, the stabs 22, 24, 26, 32, 34, 36 are formed of or include aluminum or copper.

Each of the stabs 22, 24, 26, 32, 34, 36 may include a tapered end portion 22*t*, 24*t*, 26*t*, 32*t*, 34*t*, 36*t* such that the stab narrows in thickness from a central portion of the stab to a distal end thereof. For example, FIG. 1 illustrates the stab 22 includes the tapered end portion 22*t* such that the stab 22 narrows in thickness from a central portion 22*c* portion of the stab 22 to a distal end 22*e* of the stab 22.

The housing 12 includes a top or upper portion 28 and a bottom or lower portion 30. An opening 70 is defined in the upper portion 28 of the housing 12. A ground stab (or ground conductor) 72 extends outwardly from the opening 70. The ground conductor 72 may include a convex outer or upper surface 72U that extends above a top 29 of the housing 12. The ground conductor 72 may be dome shaped. The ground conductor 72 may be resilient (e.g., allow some deformation in the upward and downward directions in response to a normal force applied thereto). The ground conductor 72 may be formed of any suitable electrically conductive material, e.g., aluminum or copper.

Each stab 22, 24, 26, 32, 34, 36, 72 may include a cable or wire lead 23, 25, 27, 33, 35, 37, 73 associated therewith. Each cable 23, 25, 27, 33, 35, 37, 73 may extend from its associated stab to outside the housing 12 at the lower portion 30 thereof. More specifically, each cable 23, 25, 27, 33, 35, 37, 73 may include a first end that is attached (e.g., brazed, welded, mechanically crimped, etc.) to its associated stab and a second, opposite end that extends out the lower portion 30 of the housing 12 (e.g., out of one or more openings at the lower portion 30 of the housing 12). As described in more detail below, the second end of each cable 23*e*, 25*e*, 27*e*, 33*e*, 35*e*, 37*e*, 73*e* may be connected to an enclosure that, along with the stab base'assembly 10, forms a plug-in device or unit (e.g., the plug-in device or unit 100 shown in FIG. 5).

The stabs 22, 24, and 32 may be phase conductors for a three-phase circuit or system. For example, the stab 22 may be an A phase conductor, the stab 24 may be a B phase conductor, and the stab 32 may be a C phase conductor.

The stabs 26, 34 and/or 36 may be omitted in some embodiments. Where used, the stab 26 may be a ground conductor for a 200% ground rating. Where used, the stab 34 may be a neutral conductor. Where used in combination with the stab 34, the stab 36 may be a neutral conductor for a 200% neutral rating.

The stab base housing 12 may include at least one alignment feature, shown as first and second alignment tabs 64, 66. The first alignment tab 64 may extend outwardly away from the first side 14 of the housing 12 and a second alignment tab 66 may extend outwardly away from the second side 16 of the housing 12. The first tab 64 may have a first length L1 and the second tab 66 may have a second length L2. The second length L2 may be greater than the first length L1.

A coupling feature, such as first and second flanges 76, 78, can reside at the lower portion 30 of the housing 12, typically below the alignment tabs 64, 66. More specifically, the first flange 76 may extend outwardly away from the third side 18 of the housing 12 and the second flange 78 may extend outwardly away from the fourth side 20 of the housing 12. Each flange 76, 78 may have an aperture defined therein to facilitate connection of the stab base assembly 10 to an enclosure (see, e.g., the aperture 76*a* shown in FIG. 5).

Figure 5:
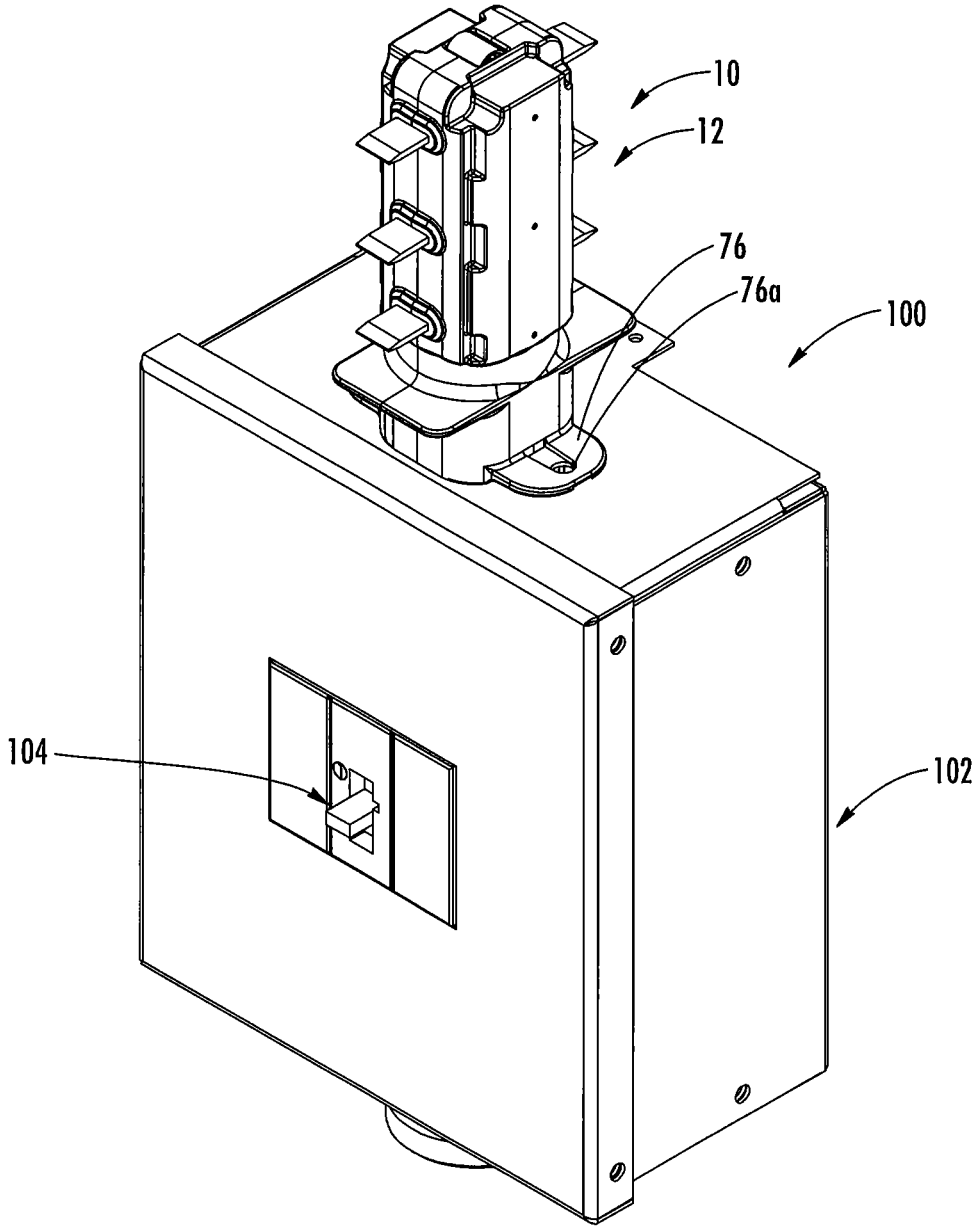
FIG. 5 is a perspective view of a plug-in device including the stab base assembly of FIG. 1 according to some embodiments.

A plug-in device or unit 100 is illustrated in FIG. 5. The plug-in device 100 includes the stab base assembly 10 coupled to a top of an enclosure 102 using the flanges 76, 78. The cables 23, 25, 27, 33, 35, 37 (FIGS. 1-4) may extend into and be electrically connected to components in the enclosure in an interior thereof. As described in more detail below, the plug-in device 100 is configured to be received in and electrically connected to a busway system. The plug-in device 100 may be, for example, a bus plug, an outlet box or a tap off. The plug-in device 100 may include a protective device (e.g., breaker or fused) switch 104.

Figure 6:
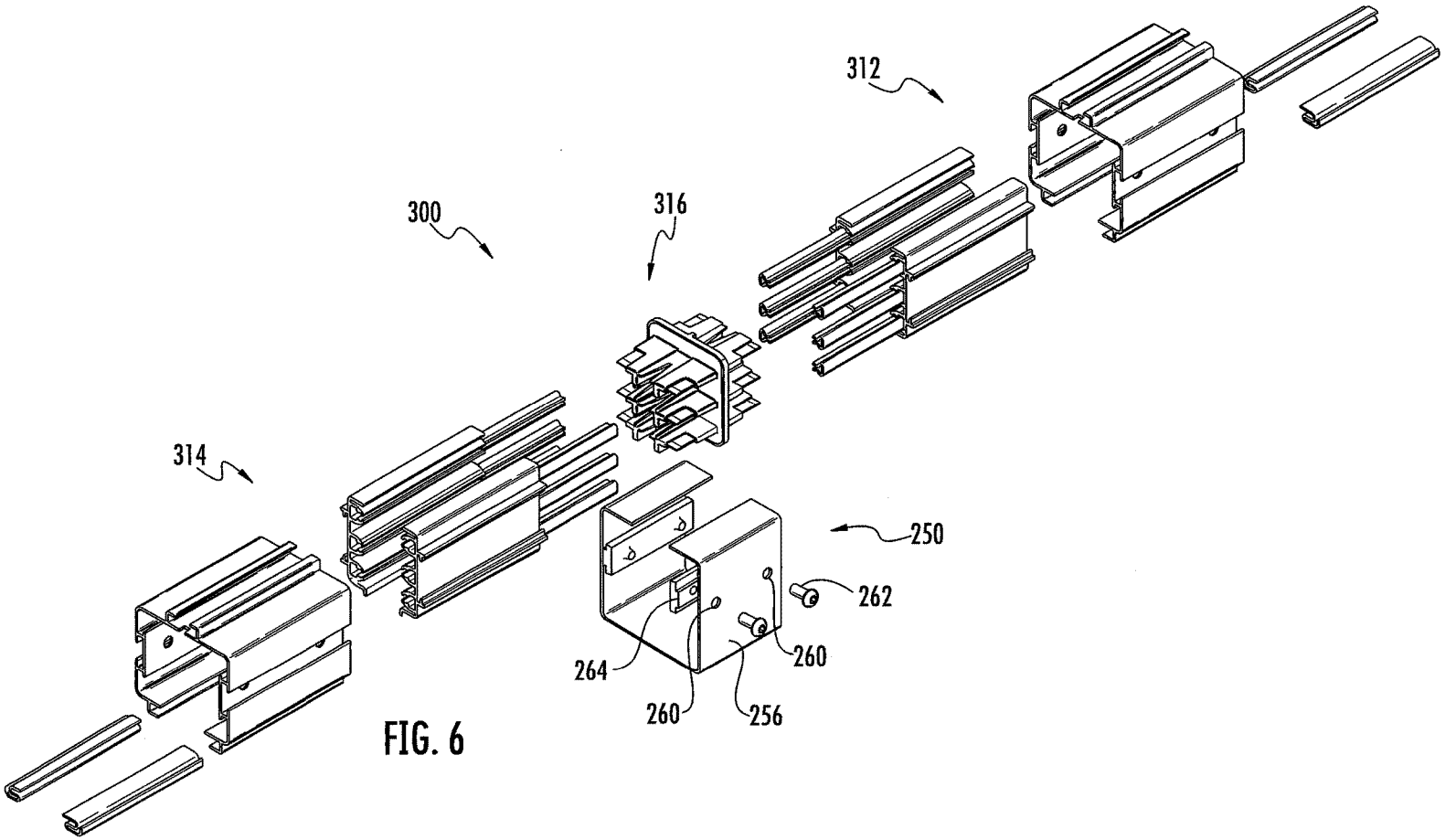
FIG. 6 is an exploded perspective view of a busway system according to some embodiments.

The stab assembly 10 and the plug-in device 100 may be used with a busway assembly or system such as the busway or bus duct system assembly 300 illustrated in FIG. 6. The busway assembly 300 includes first and second busway or bus duct sections 312, 314. A joint assembly 316 is disposed between the first and second busway sections 312, 314 to couple the busway sections 312, 314. The busway assembly 300 typically forms a portion of a larger busway system or busway run, and one or more additional busway sections, joint assemblies and/or other components may be included in the larger busway system.

Figure 7:
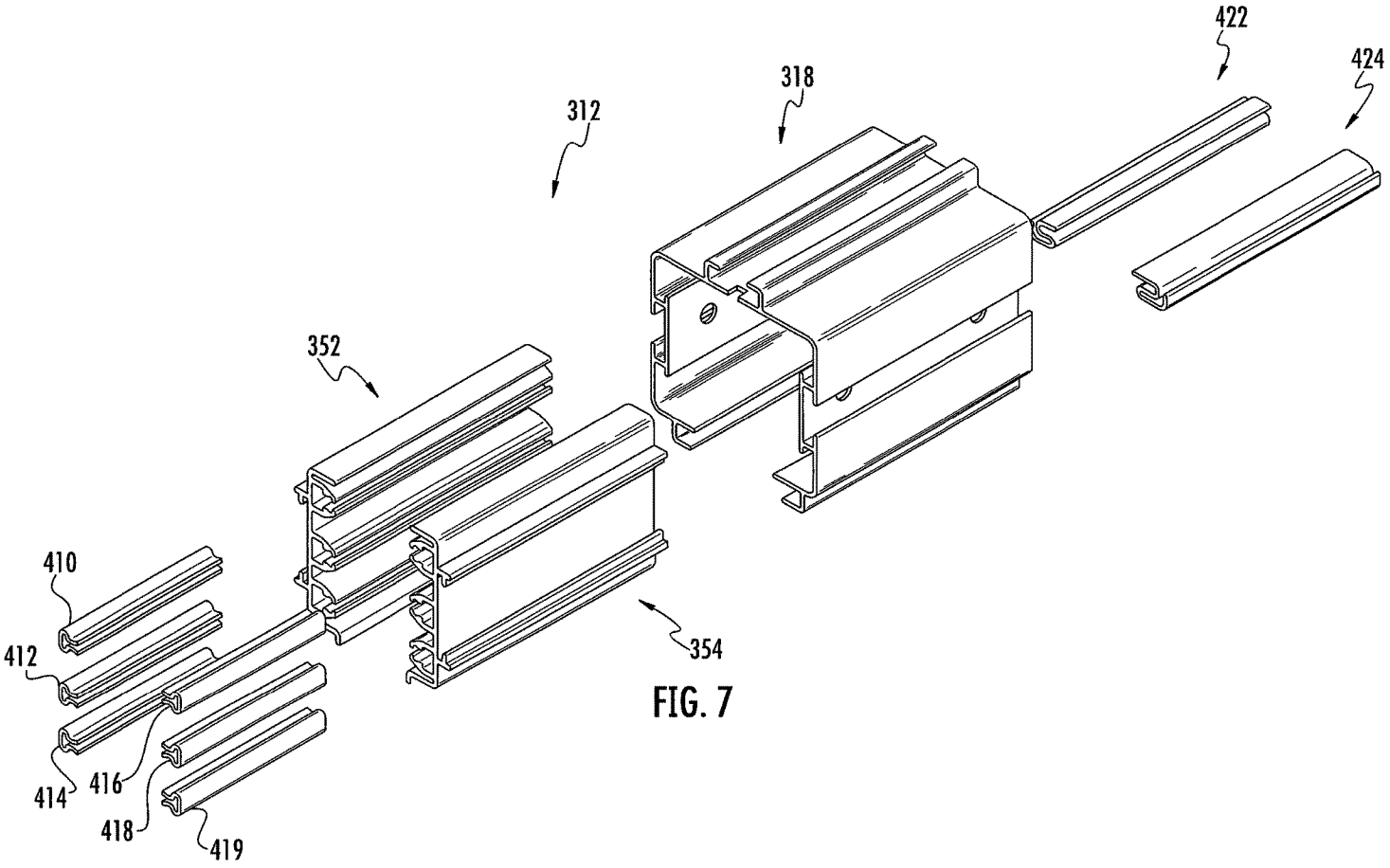
FIG. 7 is an exploded perspective view of a busway section according to some embodiments.

The busway section 312 is illustrated in FIG. 7. The busway section 314 has substantially the same structure as the busway section 312; accordingly, in the interest of brevity, only the busway section 312 will be described in detail below.

Figure 8:
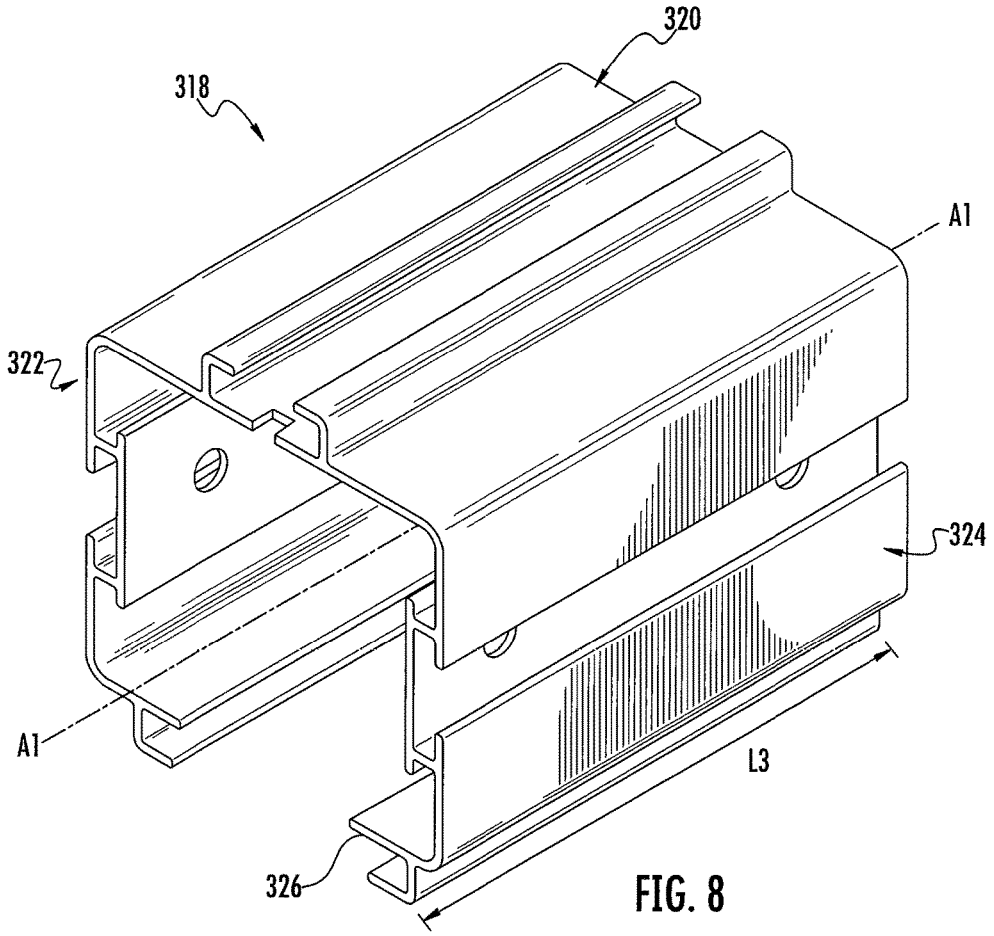
FIG. 8 is a perspective view of a housing of the busway section of FIG. 7.

The busway section 312 includes a housing 318. The housing 318 may be formed of any suitable material such as, for example, aluminum. Referring to FIG. 8, the housing 318 is elongated and defines a longitudinal axis A1. The housing 318 has a length L3. The length L3 may be between about 0.5 to 10 feet in various embodiments.

Figure 9:
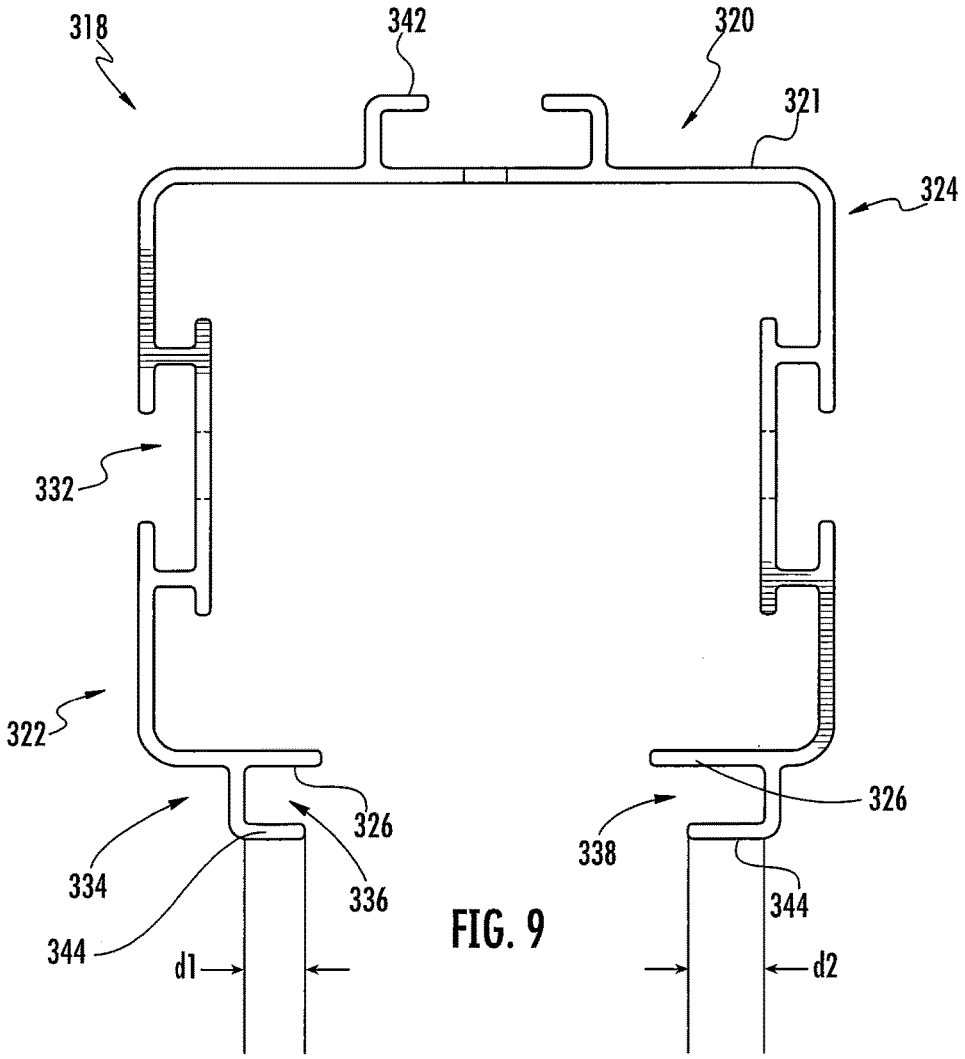
FIG. 9 is an end view of the housing of FIG. 8.

Referring to FIGS. 8 and 9, the housing 318 has a top or upper portion 320, a bottom or lower portion 334, and first and second opposing side portions 322, 324. A lower ledge 326 extends inwardly from each of the side portions 322, 324 and extends the length L3 of the housing 318. The housing side portions 322, 324 each include a channel 332.

The housing top portion 320 includes a pair of upper flanges 342 (e.g., substantially L-shaped opposed flanges) that extend from a top or upper wall 321. The flanges 342 may be used for mounting or suspending the busway section 312. A lower flange 344 (e.g., a substantially L-shaped flange) extends downwardly from each one of the ledges 326. The flanges 344 may be shaped and configured to receive finger safe seals as well as access barriers, as will be described in more detail below.

A first one of the lower ledges 326 and a first one of the lower flanges 344 define a first channel 336 at the first side 322 and the lower portion 334 of the housing 318. A second one of the lower ledges 326 and a second one of the lower flanges 344 define a second channel 338 at the second side 324 and the lower portion 334 of the housing 318. The first channel 336 has a laterally extending first depth d1 and the second channel 338 has a laterally extending second depth d2. The second depth d2 of the second channel 338 is greater (longer) than the first depth d1 of the first channel 336.

Figure 12:
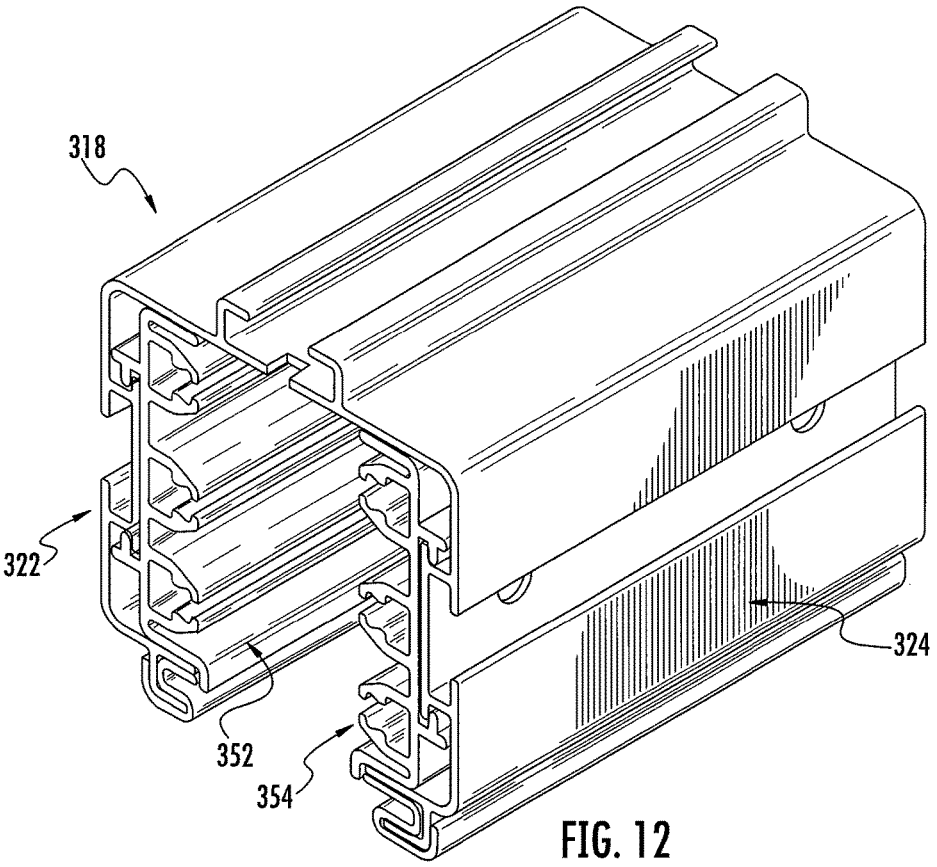
FIG. 12 is a perspective view of a housing holding two insulators of the busway section of FIG. 7.
Figure 15:
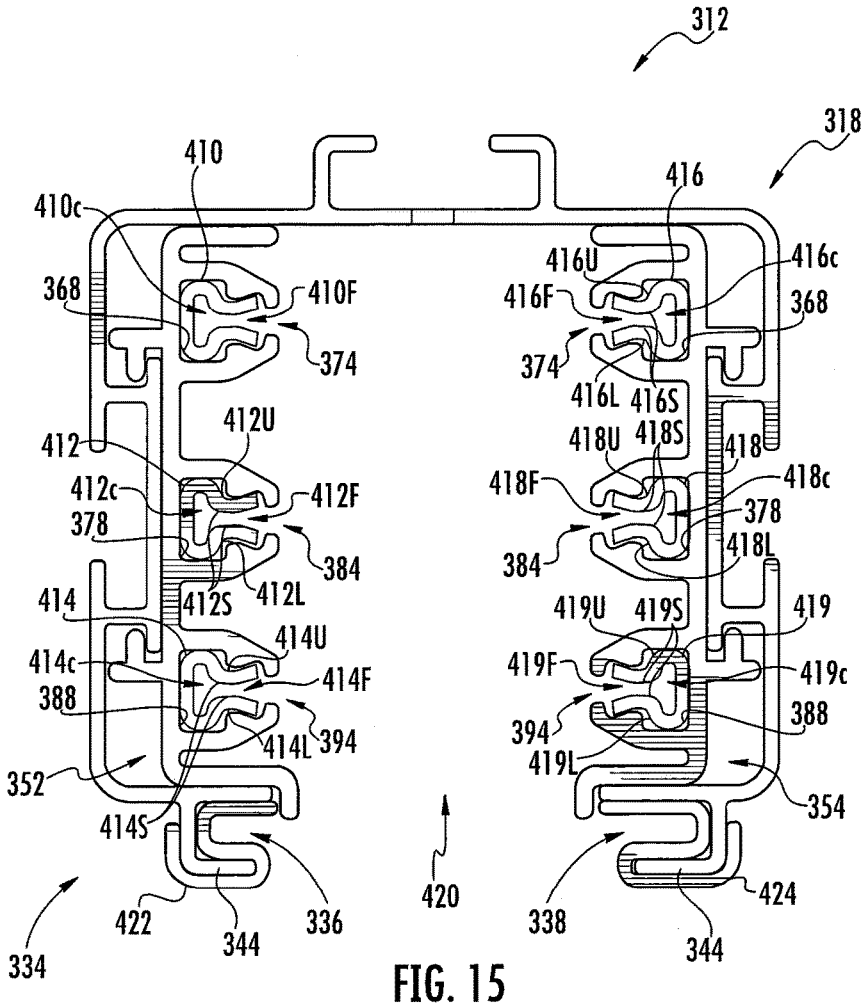
FIG. 15 is an end view of the busway section of FIG. 7 in an assembled state.

Referring again to FIG. 7, the busway section 312 includes first and second insulators 352, 354. The first and second insulators 352, 354 are received in the housing 318 at the first and second side portions 322, 324, respectively (FIGS. 12 and 15). The insulators 352, 354 are continuous and may have the same length (L4 in FIG. 10) or about the same length as the length L3 of the housing 318 (FIG. 8).

Figure 10:
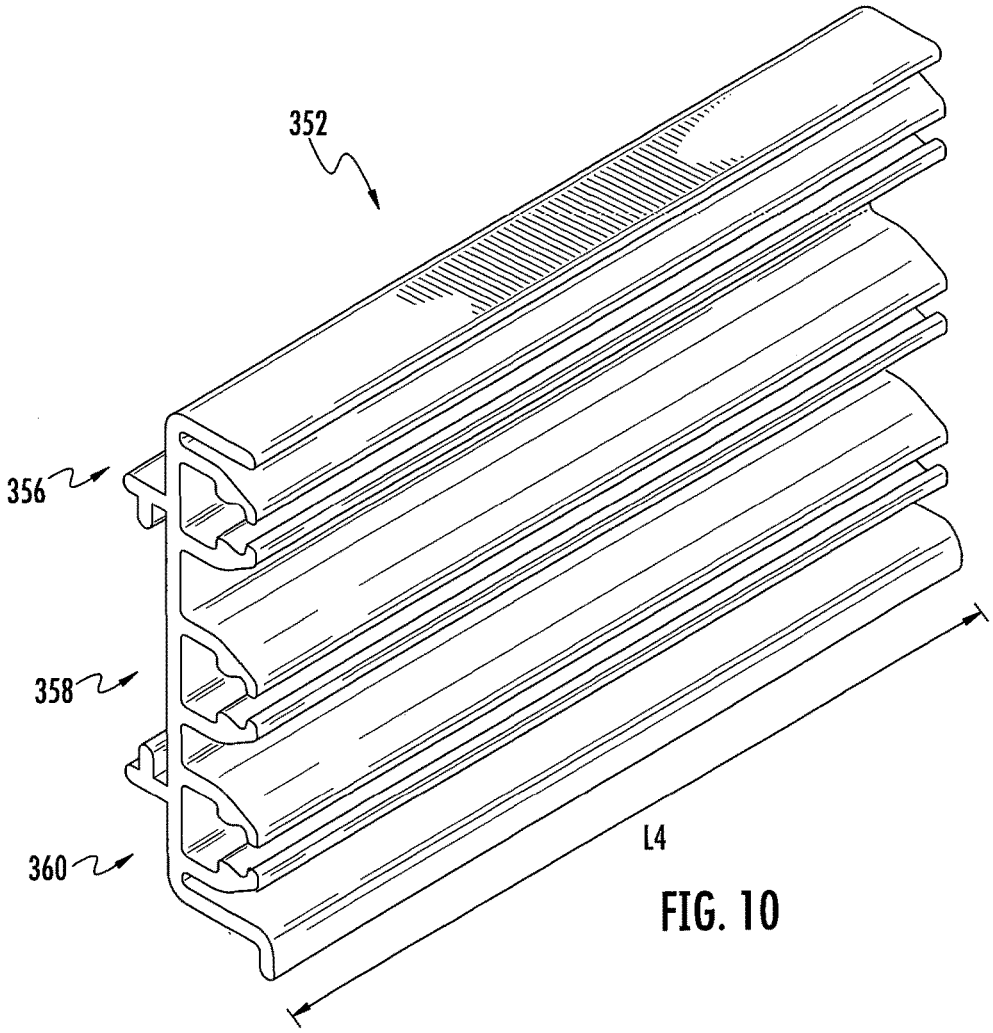
FIG. 10 is a perspective view of an insulator of the busway section of FIG. 7.
Figure 11:
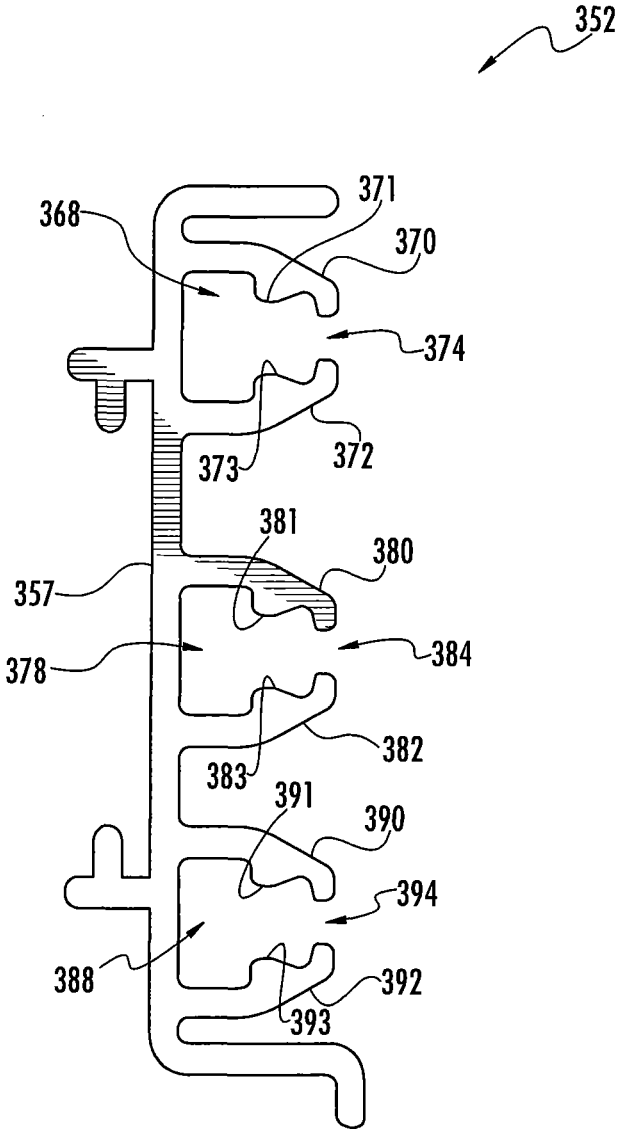
FIG. 11 is an end view of the insulator of FIG. 10.

A perspective view of the insulator 352 is shown in FIG. 10 and an end view of the insulator 352 is shown in FIG. 11. When viewed from the end, the insulator 354 is a mirror image of the insulator 352. Accordingly, in the interest of brevity, only the insulator 352 will be described in detail below.

Referring to FIG. 10, the insulator 352 includes a top or upper portion 356, a central or middle portion 358 and a bottom or lower portion 360. Referring to FIGS. 10 and 11, the insulator 352 includes an outer wall 357 that extends from the upper portion 356 to the lower portion 360 of the insulator 352. The upper portion 356 includes an upper channel 368 that is sized and configured to receive and/or hold a conductor or bus bar. Inwardly extending projections 370, 372 define an opening 374 to the channel 368. Each of the projections 370, 372 include a raised portion 371, 373 such that the channel 368 narrows between the raised portion 371, 373. The outer wall 357 and the projections 370, 372 define the upper channel 368.

The central portion 358 of the insulator 352 includes a channel 378 that is sized and configured to receive and/or hold a conductor or bus bar. Projections 380, 382 define an opening 384 to the channel 378. Each of the projections 380, 382 include a raised portion 381, 383 such that the channel 378 narrows between the raised portion 381, 383. The outer wall 357 and the projections 380, 382 define the central channel 368.

The lower portion 360 of the insulator 352 includes a channel 388 sized and configured to receive and/or hold a conductor or a bus bar. The channel 388 may have the same shape and/or size as the channel 368 and/or the channel 378. Projections 390, 392 define an opening 394 to the channel 388. Each of the projections 390, 392 include a raised portion 391, 393 such that the channel 388 narrows between the raised portion 391, 393. The outer wall 357 and the projections 390, 392 define the lower channel 388.

FIG. 12 is a perspective view illustrating the insulators 352, 354 installed in the housing 318. Specifically, the insulator 352 is installed at the side portion 322 of the housing 318 and the insulator 354 is installed at the opposite side portion 324 of the housing 318. The insulators 352, 354 may extend continuously along the housing 318 (i.e., along the entire length L3 or substantially the entire length L3 of the housing 318). In some embodiments, the insulators 352, 354 are slidingly received in the housing 318 in the position shown in FIG. 12. The insulators 352, 354 may be slidingly received in the housing 318 in a direction that is parallel or substantially parallel to the housing longitudinal axis A1 (FIG. 8).

The housing 318 and the insulators 352, 354 are shaped and configured and have features such that the insulators 352, 354 can be aligned with the housing 318, guided into the housing 318 and/or held in place (e.g., securely held in place) in the housing 318. These features, along with additional details of the busway assembly 300, are described in co-pending and commonly owned U.S. patent application Ser. No. 15/443,112 entitled "Busway Systems and Related Assemblies and Methods", filed Feb. 27, 2017, the disclosure of which is incorporated by reference herein in its entirety.

The insulators 352, 354 may be formed of any suitable electrically insulating material. According to some embodiments, the insulators 352, 354 are formed of a polycarbonate or a thermoplastic polycarbonate. The insulators 352, 354 may be formed of Lupoy™ available from LG Chem (e.g., LG LUPOY NF 1005F03R).

Referring again to FIG. 7, the busway section 312 includes a plurality of conductors or bus bars 410, 412, 414, 416, 418, 419. The conductors or bus bars 410, 412, 414, 416, 418, 419 may be formed of any suitable electrically conductive material; an exemplary suitable material is aluminum or copper.

Figure 13:
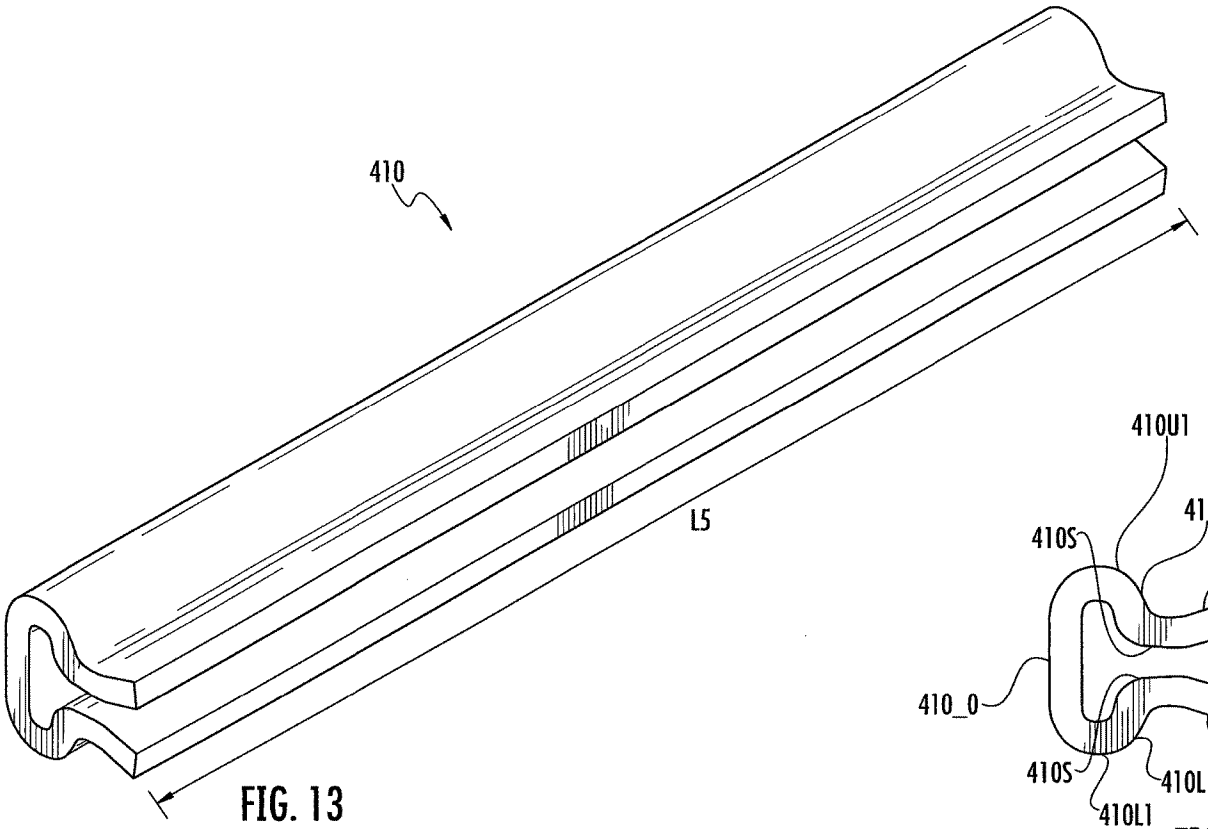
FIG. 13 is a perspective view of a bus bar conductor of the busway section of FIG. 7.
Figure 14:
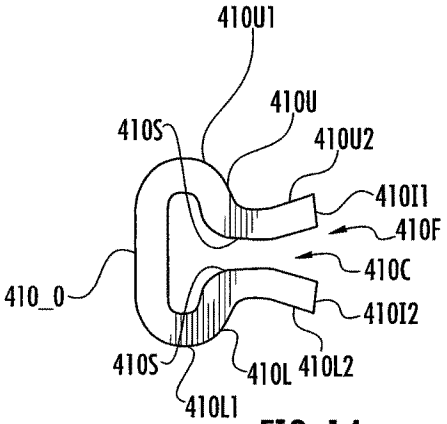
FIG. 14 is an end view of the conductor of FIG. 13.

FIG. 13 is a perspective view of the bus bar conductor 410 and FIG. 14 is an end view of the conductor 410. The conductors 412, 414, 416, 418 and 419 are the same or substantially the same as the conductor 410; therefore, in the interest of brevity, only the conductor 410 will be described in detail below.

The conductor 410 has a length L5. According to some embodiments, the length L5 is less than the length L3 of the housing 318 (FIG. 8) and/or the length L4 of the insulators 352, 354 (FIG. 10). According to some embodiments, the length L5 of the conductor 410 is about 1 to 2 inches less than the length L3 of the housing 318 and/or the length L4 of the insulators 352, 354. According to some embodiments, the length L5 of the conductor 410 is about 1 to 1.25 inches less than the length L3 of the housing 318 and/or the length L4 of the insulators 352, 354.

Referring to FIG. 14, the conductor 410 may have a "butterfly" profile. More specifically, the conductor 410 includes a straight or substantially straight outer portion 410_O and opposite upper and lower (or first and second) curved or bent portions 410U, 410L. The upper portion 410U includes a first upper portion 410U1 that extends away from the outer portion 410_O and curves or bends downwardly and a second upper portion 410U2 that extends away from the first upper portion 410U1 and curves or bends upwardly. A contact surface 410S is defined between or at an interface of the first and second upper portions 410U1, 410U2 (although it will be understood that the contact surface 410S may be defined by a portion of the first upper portion 410U1 and/or a portion of the second upper portion 410U2). The second upper portion 410U2 terminates at a first inner end 41011 of the conductor 410.

Similarly, the lower portion 410L includes a first lower portion 410L1 that extends away from the outer portion 410_O and curves or bends upwardly and a second lower portion 410L2 that extends away from the first lower portion 410L1 and curves or bends downwardly. A contact surface 410S is defined between or at an interface of the first and second lower portions 410L1, 410L2 (although it will be understood that the contact surface 410S may be defined by a portion of the first lower portion 410L1 and/or a portion of the second lower portion 410L2). The second lower portion 410L2 terminates at a second inner end 41012 of the conductor 410.

The conductor outer portion 410_O and the upper and lower portions 410U, 410L define a lengthwise channel 410*c*. The channel 410*c* tapers inwardly from the first and second inner ends 41011, 41012 to the contact surface 410S of the conductor 410. In other words, the conductor 410 includes a flared opening 410F to the channel 410*c*. This may facilitate alignment and/or guidance for the insertion of a conductor or stab of a plug-in device to be received in the channel 410*c*.

The conductor 410 includes the double-sided (or dual pressure) contact surface 410S to provide increased contact surface area and/or compressive force on conductors received in the channel 410*c* of the conductor 410. As described in more detail herein, such conductors may be associated with stab base assemblies and/or plug-in devices.

It will be appreciated that each of the conductors 412, 414, 416, 418, 419 shares the same features and advantages described above in reference to the conductor 410. For example, each of the conductors 412, 414, 416, 418, 419 includes a double-sided contact surface 412S, 414S, 416S, 418S, 419S, a channel 412*c*, 414*c*, 416*c*, 418*c*, 419*c*, and a flared opening 412F, 414F, 416F, 418F, 419F as described above.

Turning to FIG. 15, the conductors or bus bars are received in channels defined in the insulators 352, 354. The conductors 410 and 412 are received in the channels 368 and 378 of the insulator 352, respectively. The conductor 416 is received in the channel 368 of the insulator 354. In some embodiments, the conductor 414 is received in the channel 388 of the insulator 352. In some embodiments, the conductor 418 is received in the channel 378 of the insulator 354. In some embodiments, the conductor 419 is received in the channel 388 of the insulator 354.

The conductors 410, 412 and 416 may be phase conductors or bus bars (e.g., the conductor 410 may be an A phase conductor, the conductor 412 may be a B phase conductor and the conductor 416 may be a C phase conductor), the conductor 414 may be a ground conductor or bus bar, and the conductor 418 may be a neutral conductor or bus bar. Such a configuration can be used for a three phase busway system, although other configurations are contemplated including single phase and two phase busway systems.

In some embodiments, the conductor 414, the conductor 418 and/or the conductor 419 may be omitted. For example, the conductor 414 may be omitted and the housing 318 may provide standard ground. Rails 264 of joint cover assembly 250 (FIG. 6) may serve as ground blocks (e.g., T-shaped ground blocks) to create and maintain a housing ground path. That is, when the joint cover 250 is installed for operation (e.g., when joint cover housing 256 is secured over the joint assembly 316 by, for example, receiving fasteners 262 through apertures 260 and the rails 264 with the rails received in the channels 332 of the busway housings), the ground block or rails 264 may form a housing ground path between adjacent busway sections 312, 314. Where used, the conductor 414 may be a ground conductor or bus bar for a 200% ground rating.

Where used, the conductor 418 may be a neutral conductor or bus bar and may provide standard neutral. Where used in combination with the conductor 418, the conductor 419 may be a neutral conductor or bus bar for a 200% neutral rating.

The conductors 410, 412, 414, 416, 418, 419 may all be the same size and shape. This may reduce manufacturing costs and provide reliability and repeatability of fit within the insulator channels and placement of the contact surface area for a conductor to be coupled thereto.

The upper and lower portions of each conductor (e.g., the upper and lower portions 410U, 410L of the conductor 410 shown in FIG. 14) may be resilient and able to flex. The raised portions of the insulator projections (e.g., the raised portions 371, 373 of the projections 370, 372 shown in FIG. 11) may be adjacent and/or abut the upper and lower portions of the conductor (e.g., the upper and lower portions 410U, 410L of the conductor 410 shown in FIG. 14) to help ensure that the upper and lower portions are spaced apart the correct distance.

The busway section 312 (e.g., the housing 318 and/or the insulators 352, 354) defines a channel 420 at the lower portion 334 of the housing 318 in which plug-in devices can be received and engage the conductors 410, 412, 414, 416, 418, 419. The channel 420 is continuous along the length L3 of the housing 318 (FIG. 8) such that the busway section 312 can be used with a continuous plug-in busway system.

Referring back to FIG. 7, the busway section 312 may include first and second finger safe lip seals 422, 424. As illustrated in FIG. 15, the seals 422, 424 are shaped and configured to be received along the lower flanges 344 of the housing 318. The seals 422, 424 are formed of an electrically insulating material (e.g., a polycarbonate or a thermoplastic polycarbonate material such as LG LUPOY NF 1005F03R) and provide a safety feature to help prevent or reduce the likelihood of contact with the housing 318 and/or the conductors 410, 412, 414, 416, 418, 419 during installation or maintenance or when installing a plug-in device in the channel 420.

The seals 422, 424 may be used so that the busway system complies with safety regulations such as the Underwriters Laboratories (UL) "Finger Safe Probe" standard. In some embodiments, the seals 422, 424 may be omitted and the design may include component interface dimensions to comply with the UL "Finger Safe Probe" standard.

Figure 16:
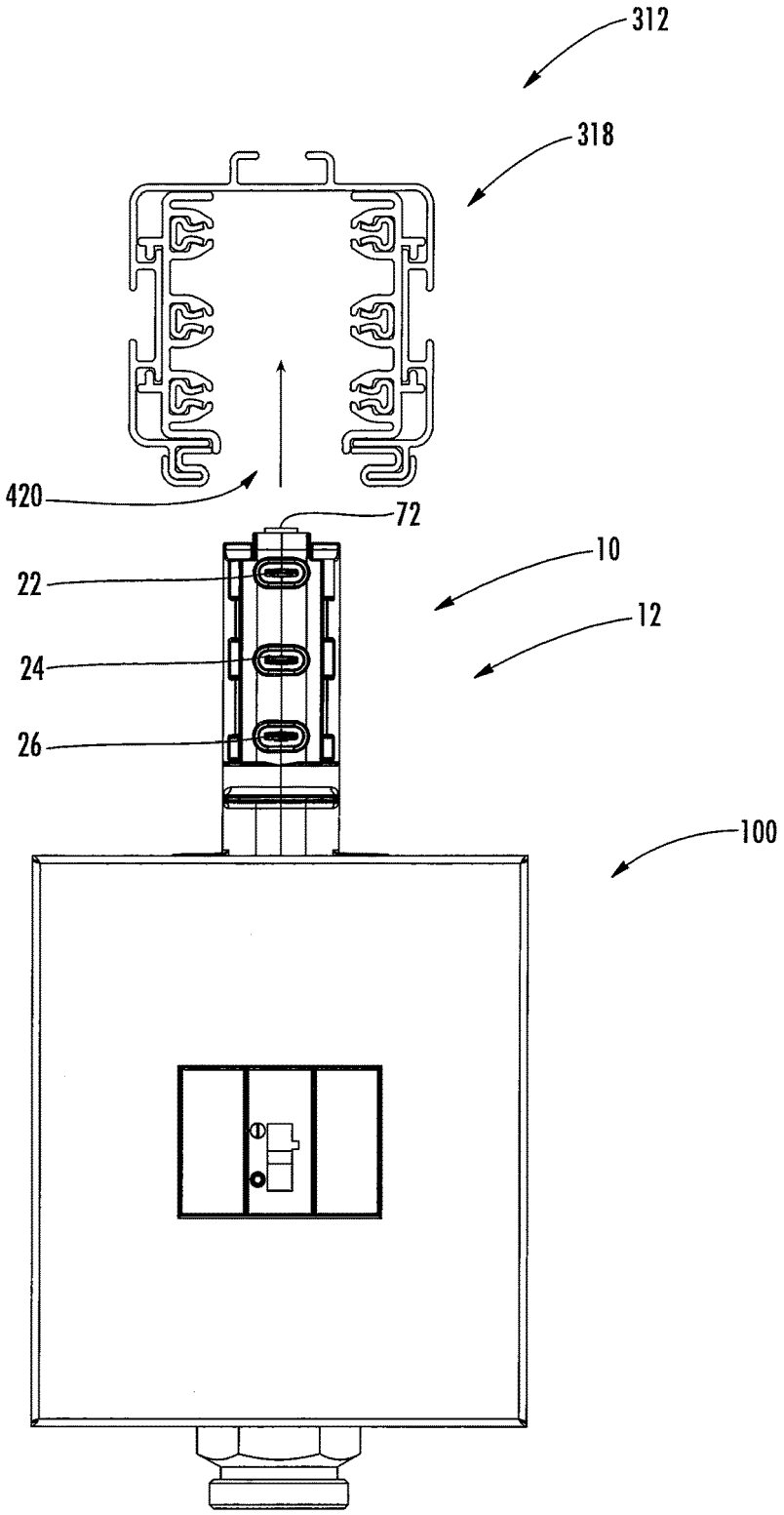
FIG. 16 illustrates the plug-in device of FIG. 5 positioned below the busway section of FIG. 15.
Figure 17:
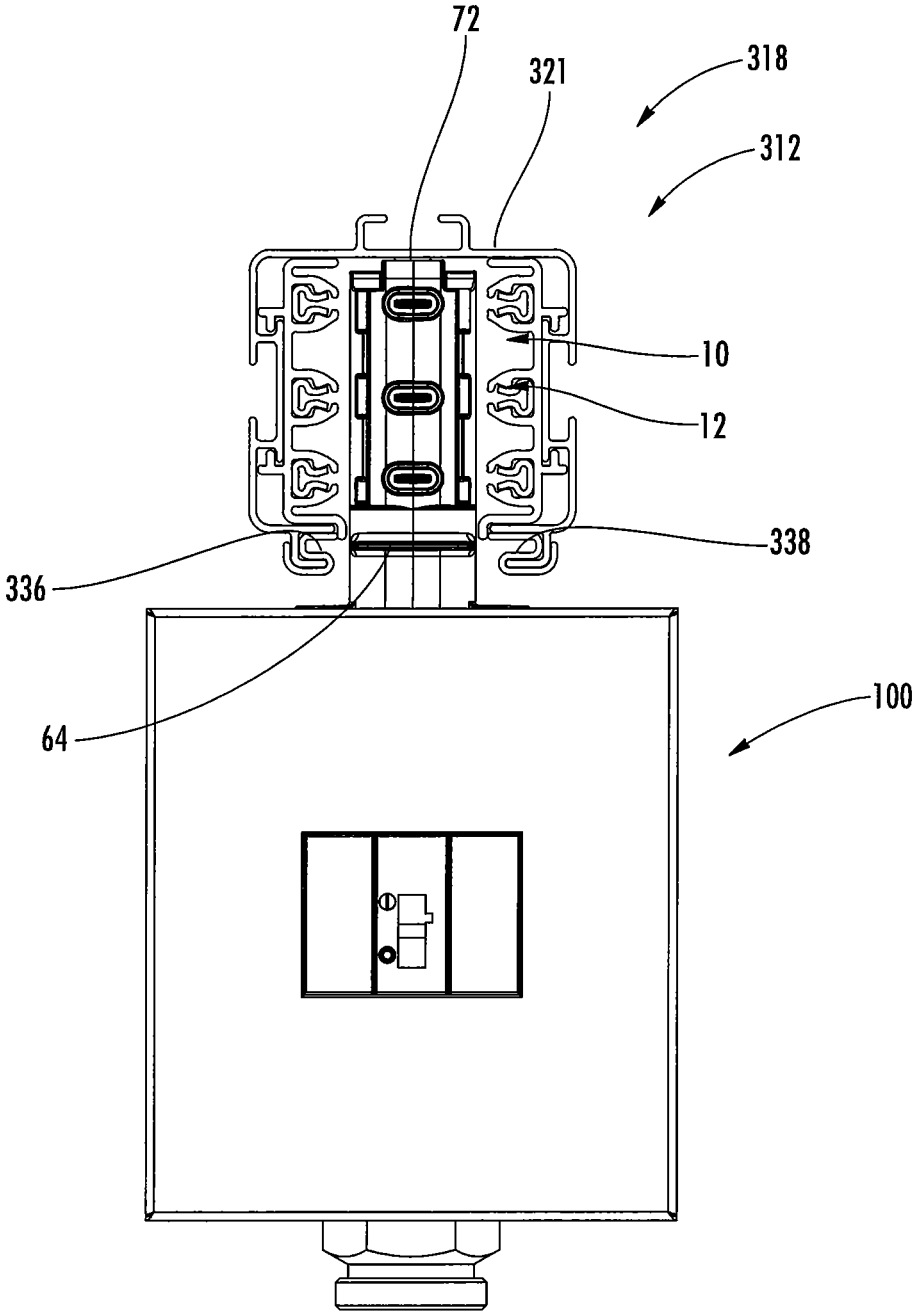
FIG. 17 illustrates the plug-in device positioned in the busway section of FIG. 15 in a first position.

The stab base assembly 10 and the plug-in device 100 may be electrically connected to the busway as will now be described. Referring to FIG. 16, the stab base assembly 10 is positioned below the opening 420 of the housing 318 of the busway section 312. Referring to FIGS. 16 and 17, the stab base assembly 10 is moved or urged upwardly through the opening 420 to a first position in the busway section 312 or busway housing 318. In the first position, the first and second stab conductors 22, 24 (FIG. 1) and the stab conductor 32 (FIG. 2) each extend away from the stab base housing 12 in a direction that is parallel or substantially parallel to the longitudinal axis A1 of the busway housing 318 (FIG. 8). Where used, the stab conductors 26, 34, and/or 36 also extend away from the stab base housing 12 in a direction that is parallel or substantially parallel to the longitudinal axis A1 of the busway housing 318 in the first position.

Also in the first position, the ground stab conductor 72 contacts the upper wall 321 of the busway housing 318. This helps ensure that the stab base assembly 10 and the plug-in device 100 are grounded before being electrically connected to the busway.

Figure 18:
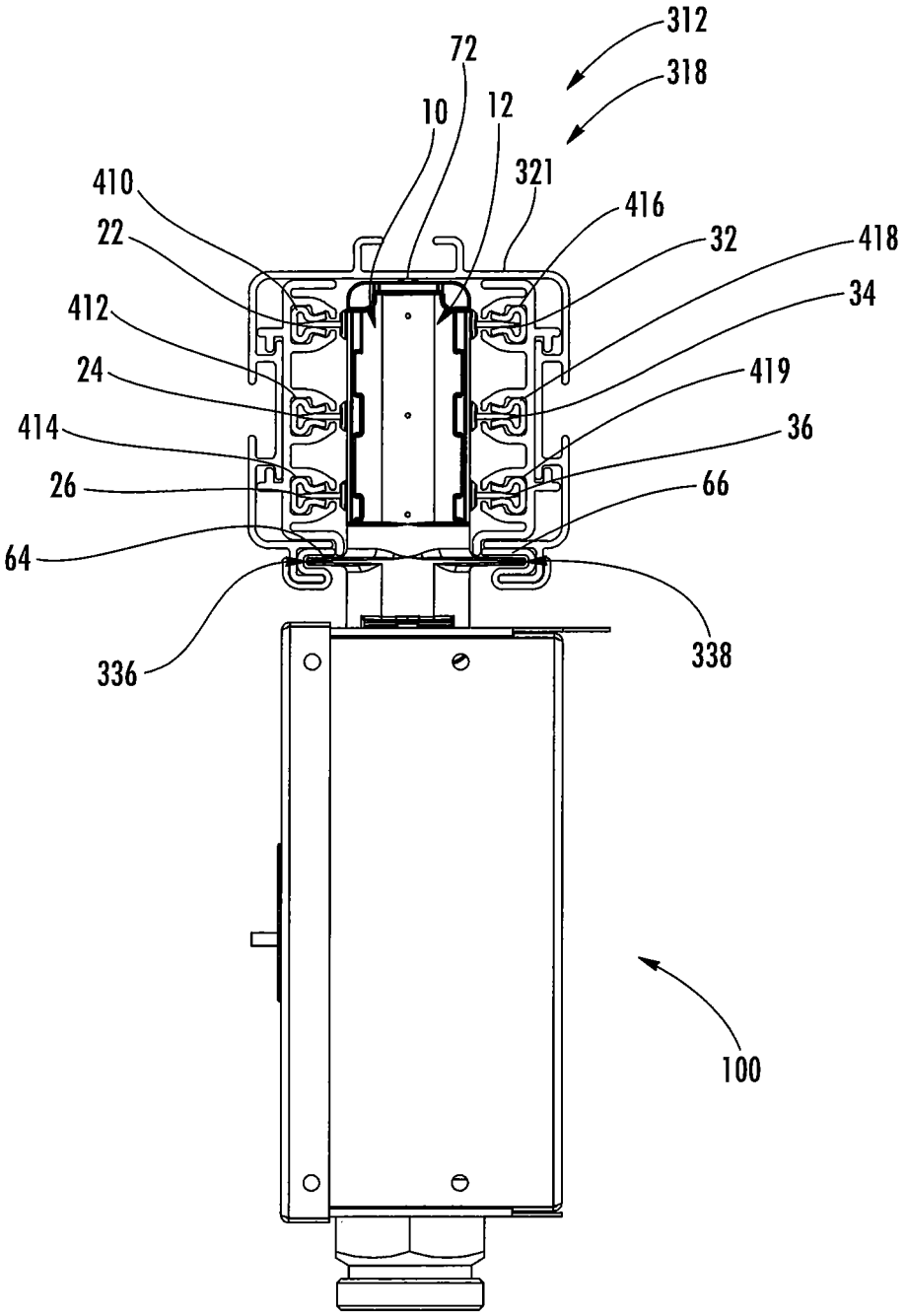
FIG. 18 illustrates the plug-in device positioned in the busway section of FIG. 15 in a second position.

The stab base assembly 10 can then be rotated to a second position illustrated in FIG. 18. The stab base assembly 10 and the plug-in device 100 are electrically connected to the busway in the second position. More specifically, the stab conductor 22 is electrically connected with the bus bar conductor 410, the stab conductor 24 is electrically connected with the bus bar conductor 412 and the stab conductor 32 is electrically connected with the bus bar conductor 418 in the second position. In addition, where used, the stab conductor 26 is electrically connected with the bus bar conductor 414, the stab conductor 34 is electrically connected with the bus bar conductor 418, and/or the stab conductor 36 is electrically connected with the bus bar conductor 419 in the second position. Referring to FIG. 15, the configuration of the insulators 352, 354 with the projections and the shape of the conductors 410, 412, 414, 416, 418, 419 may facilitate guiding the stabs into contact with the bus bar conductors.

More specifically, referring to FIGS. 15 and 18, the stab conductors 22, 24, 26, 32, 34 and/or 36 may be slidingly received in the channels 410*c*, 412*c*, 414*c*, 416*c*, 418*c* and/or 419*c*, respectively, of the busway section conductors 410, 412, 414, 416, 417, 418 and/or 419 when the stab base assembly 10 is rotated from the first to the second position. The tapered portions 22*t*, 24*t*, 26*t*, 32*t*, 34*t* and 36*t* at one end of the stab conductors 22, 24, 26, 32, 34 and 36 may help facilitate insertion into the busway section conductor channels 410*c*, 412*c*, 414*c*, 416*c*, 418*c* and 419*c* when the stab base assembly 10 is rotated from the first position to the second position. Each stab conductor is slidingly received between the upper and lower portions of the corresponding busway section conductor and makes contact with the contact surface defined thereby. For example, the stab conductor 24 is received in the channel 412*c* defined by the busway section conductor 412. The stab conductor 24 is received between the upper and lower portions 412U, 412L of the conductor 412 and contacts the contact surface 412S defined by the upper and lower portions 412U, 412L of the conductor 412.

The ground stab conductor 72 continues to contact the upper wall 321 of the busway housing 318 when the stab base assembly 10 is rotated from the first position to the second position. The ground conductor 72 may be resilient and configured to translate up and down relative to the stab base housing 12 in response to contacting the upper wall 321 of the busway housing 318. This helps ensure the ground conductor 72 maintains contact with the upper wall 321 of the busway housing 318.

The configuration of the alignment tabs 64, 66 of the stab base housing 12 and/or the channels 336, 338 of the busway housing 318 help ensure electrical polarity between the proper phasing when the stab base assembly 10 is rotated from the first position to the second position. More specifically, the relatively longer second alignment tab 66 can be received in the relatively deeper channel 338 when the stab base assembly 10 is rotated from the first position to the second position. However, the second alignment tab 66 is too long to be received in the shallower channel 336.

Put another way, the stab base assembly 10 can only be rotated in one rotational direction from the first position shown in FIG. 17 to reach the second position shown in FIG. 18. As illustrated, the stab base assembly can only be rotated in the counterclockwise direction to reach the second position such that the stab conductors are electrically connected with the bus bar conductors of the busway. This prevents an electrical connection with incorrect polarity.

Referring again to FIGS. 1 and 2, the stab base housing 12 includes a first rounded portion 80 above the first alignment tab 64 and a second rounded portion 82 above the second alignment tab 66. The first and second rounded portions 80, 82 may be concave portions. The first and second rounded portions 80, 82 facilitate sliding of the first and second alignment tabs 64, 66 in the first and second busway housing channels 336, 338, respectively, when the stab base assembly 10 is rotated from the first position to the second position. The rounded portions 80, 82 may help prevent the stab base housing 12 from binding in the busway housing 318 during rotation.

The alignment feature of the stab base housing may take other forms. As just one example, the stab base housing 12 may include channels, recesses or slots defined therein and the busway housing 318 may include tabs configured to be received in the channels of the stab base housing 12. The tabs and the channels may be sized to allow rotation in only one rotational direction.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

What is claimed is:

1. A plug-in device for use with a busway system comprising a busway housing defining a longitudinal axis, the plug-in device comprising:

a stab base housing having first and second opposite sides, an upper portion, and a lower portion;

one or more stab conductors extending out of and away from the stab base housing at the first side of the stab base housing;

one or more stab conductors extending out of and away from the stab base housing at the second side of the stab base housing; and a ground conductor extending upwardly from the upper portion of the stab base housing;

wherein the stab base housing is configured to be received through an opening at a bottom portion of the busway housing and positioned in a first position with each stab conductor extending away from the stab base housing in a direction substantially parallel to the longitudinal axis of the busway housing and with the ground conductor contacting a top wall of the busway housing;

wherein the stab base housing is configured to be rotated from the first position to a second position with each stab conductor extending away from the stab base housing in a direction substantially perpendicular to the longitudinal axis of the busway housing and with the ground conductor contacting the top wall of the busway housing;

wherein the stab base housing comprises an alignment feature configured to allow rotation of the stab base housing from the first position to the second position in only one rotational direction;

wherein the ground conductor is resilient and configured to translate up and down relative to the stab base housing in response to contact with the top wall of the busway housing.

2. The plug-in device of claim 1 wherein:

the alignment feature comprises a first alignment tab on the first side of the stab base housing and a second alignment tab on the second side of the stab base housing; and the first alignment tab has a first length and the second alignment tab has a second length that is greater than the first length.

3. The plug-in device of claim 1 wherein:

the one or more stab conductors extending out of and away from the stab base housing at the first side of the stab base housing comprise first and second phase conductors; and the one or more stab conductors extending out of and away from the stab base housing at the second side of the stab base housing comprise a third phase conductor.

4. The plug-in device of claim 3 wherein the one or more stab conductors extending out of and away from the stab base housing at the first side of the stab base housing comprise a ground conductor for a 200% ground rating.

5. The plug-in device of claim 1 wherein:

the one or more stab conductors extending out of and away from the stab base housing at the first side of the stab base housing comprise first and second phase conductors; and the one or more stab conductors extending out of and away from the stab base housing at the second side of the stab base housing comprise a third phase conductor and a neutral conductor.

6. The plug-in device of claim 5 wherein:

the neutral conductor is a first neutral conductor; and the one or more stab conductors extending out of and away from the stab base housing at the second side of the stab base housing comprise a second neutral conductor for a 200% neutral rating.

7. The plug-in device of claim 1 wherein:

the stab base housing includes a coupling feature at the lower portion thereof for coupling the stab base housing to an enclosure.

8. The plug-in device of claim 7 wherein:

the plug-in device includes the enclosure;

a cable extends from each stab conductor to outside the stab base housing at the lower portion thereof; and each cable is electrically connected to components in the enclosure.

9. A busway system comprising:

a busway section comprising:

a busway housing defining a longitudinal axis, the busway housing comprising first and second opposite side portions;

a first insulator held in the first side portion of the busway housing, the first insulator holding one or more bus bar conductors;

a second insulator held in the second side portion of the housing, the second insulator holding one or more bus bar conductors; and a plug-in device comprising:

a stab base housing having first and second opposite sides;

one or more stab conductors extending out of and away from the stab base housing at the first side of the stab base housing;

one or more stab conductors extending out of and away from the stab base housing at the second side of the stab base housing;

wherein the stab base housing is configured to be received through an opening at a bottom portion of the busway housing and positioned in a first position with each stab conductor extending away from the stab base housing in a direction substantially parallel to the longitudinal axis of the busway housing;

wherein the stab base housing is configured to be rotated from the first position to a second position with each stab conductor extending away from the stab base housing in a direction substantially perpendicular to the longitudinal axis of the busway housing;

wherein each stab base conductor is electrically connected to one of the bus bar conductors in the second position;

wherein the stab base housing comprises an alignment feature configured to allow rotation of the stab base housing from the first position to the second position in only one rotational direction;

wherein:

the stab base housing includes an upper portion and a lower portion;

the plug-in device includes a ground conductor including a convex upper surface that extends upwardly from the upper portion of the stab base housing; and the ground conductor is resilient and configured to translate up and down relative to the stab base housing in response to contact with a top wall of the busway housing.

10. The system of claim 9 wherein:

each bus bar conductor held in the first insulator comprises an upper portion and an opposite lower portion;

each bus bar conductor held in the second insulator comprises an upper portion and an opposite lower portion;

in the second position, each one of the stab conductors extending out of and away from the stab base housing at the first side of the stab base housing is received between and contacts the upper and lower portions of one of the bus bar conductors held in the first insulator to be electrically connected therewith; and in the second position, each one of the stab conductors extending out of and away from the stab base housing at the second side of the stab base housing is received between and contacts the upper and lower portions of one of the bus bar conductors held in the second insulator to be electrically connected therewith.

11. The system of claim 9 wherein each of the stab conductors comprises an end portion that is tapered such that the end portion narrows in thickness from a central portion to an end of the stab conductor.

12. The system of claim 9 wherein: the alignment feature comprises a first alignment tab on the first side of the stab base housing and a second alignment tab on the second side of the stab base housing; and the first alignment tab has a first length and the second alignment tab has a second length that is greater than the first length.

13. The system of claim 12 wherein:

the busway housing includes a first channel and a second channel at the bottom portion of the busway housing;

the first channel has a first depth and the second channel has a second depth that is greater than the first depth; and the first alignment tab is received in the first channel and the second alignment tab is received in the second channel when the stab base housing is in the second position.

14. The system of claim 13 wherein the stab base housing comprises a first concave rounded portion above the first alignment tab and a second concave rounded portion above the second alignment tab.

15. A method comprising:

providing a busway section comprising:

a busway housing defining a longitudinal axis, the busway housing comprising first and second opposite side portions;

a first insulator held in the first side portion of the busway housing, the first insulator holding one or more bus bar conductors;

a second insulator held in the second side portion of the housing, the second insulator holding one or more bus bar conductors; and providing a plug-in device comprising:

a stab base housing having first and second opposite sides;

one or more stab conductors extending out of and away from the stab base housing at the first side of the stab base housing;

one or more stab conductors extending out of and away from the stab base housing at the second side of the stab base housing; and a ground conductor extending upwardly from an upper portion of the stab base housing;

receiving the stab base housing through an opening in a bottom portion of the busway housing in a first position with each stab conductor extending away from the stab base housing in a direction substantially parallel to the longitudinal axis of the busway housing and with the ground conductor contacting a top wall of the busway housing; and rotating the stab base housing from the first position to a second position with each stab conductor extending away from the stab base housing in a direction substantially perpendicular to the longitudinal axis of the busway housing and with the ground conductor contacting the top wall of the busway housing;

wherein the stab base housing comprises an alignment feature configured to allow rotation of the stab base housing from the first position to the second position in only one rotational direction;

wherein the ground conductor is resilient and configured to translate up and down relative to the stab base housing in response to contact with the top wall of the busway housing.

16. The method of claim 15 wherein rotating the stab base housing from the first position to the second position comprises electrically connecting each one of the stab conductors to one of the bus bar conductors.

17. The method of claim 15 wherein:

each bus bar conductor held in the first insulator comprises an upper portion and an opposite lower portion;

each bus bar conductor held in the second insulator comprises an upper portion and an opposite lower portion;

rotating the stab base housing from the first position to the second position comprises receiving each one of the stab conductors extending out of and away from the stab base housing at the first side of the stab base housing between the upper and lower portions of one of the bus bar conductors held in the first insulator to be electrically connected therewith; and rotating the stab base housing from the first position to the second position comprises receiving each one of the stab conductors extending out of and away from the stab base housing at the second side of the stab base housing between the upper and lower portions of one of the bus bar conductors held in the second insulator to be electrically connected therewith.

18. The method of claim 15 wherein:

the alignment feature comprises a first alignment tab on the first side of the stab base housing and a second alignment tab on the second side of the stab base housing;

the first alignment tab has a first length and the second alignment tab has a second length that is greater than the first length;

the busway housing includes a first channel and a second channel at the bottom portion of the busway housing;

the first channel has a first depth and the second channel tab has a second depth that is greater than the first depth; and rotating the stab base housing from the first position to a second position comprises slidably receiving the first alignment tab in the first channel of the busway housing and slidably receiving the second alignment tab in the second channel of the busway housing.

* * * * *